United States Patent [19]

Scheck

[11] 4,009,878

[45] Mar. 1, 1977

[54] SHEET CARRYING APPARATUS

[75] Inventor: Paul Scheck, Prille, Switzerland

[73] Assignee: J. Bobst & Fils, S.A., Switzerland

[22] Filed: Sept. 11, 1975

[21] Appl. No.: 612,571

[30] Foreign Application Priority Data

Oct. 2, 1974 Switzerland ..... 013250/74

[52] U.S. Cl. ..... 271/272; 271/275

[51] Int. Cl.[2] ..... B65H 5/02

[58] Field of Search ..... 271/272, 273, 274, 275, 271/35, 37, 38, 135

[56] References Cited

UNITED STATES PATENTS

| | | | |
|---|---|---|---|
| 2,809,033 | 10/1957 | Guggenheim | 271/273 |
| 3,166,311 | 1/1965 | Rabinow | 271/273 X |
| 3,761,075 | 9/1973 | Van Namen | 271/274 |
| 3,874,652 | 4/1975 | Bilbrey | 271/35 X |

*Primary Examiner*—Richard A. Schacher
*Attorney, Agent, or Firm*—Hill, Gross, Simpson, Van Santen, Steadman, Chiara & Simpson

[57] ABSTRACT

A sheet carrying apparatus for use in a sheet processing machine characterized by a continuously moving belt for transporting a sheet from a sheet receiving station, a pressing member coacting with the belt to ensure nipping of a leading edge of a sheet between the pressing member and belt as the sheet is received at the sheet receiving station, and a device for shifting the pressure member between an advanced position engaging the leading edge of the sheet in the sheet receiving station and a retracted position which is clear of the leading edge of the sheet as it is received on the belt. Preferably, the pressure member is a roller mounted on an end of a lever which pivots on an axle and the axle is provided with pinion gears at each end which are engaged on spaced rack gears with the shifting device including an actuator such as a pneumatic cylinder engaging one end of the axle and a guide for each end of the axle so that the axle moves in a linear path.

10 Claims, 3 Drawing Figures

SHEET CARRYING APPARATUS

BACKGROUND OF THE INVENTION

1. Field of the Invention

The present invention is directed to a sheet transporting or carrying apparatus for use in a sheet processing machine.

2. Prior Art

In sheet processing machines which have several operating stations, sheets are introduced into the machine one at a time and are conveyed from one station to another. During conveyance of the sheets between the stations, several problems have been encountered. One of these problems is the maintenance of an accurate position and orientation of the sheet as it is being conveyed from one station to the next. Another problem is to ensure removal of a sheet from one station prior to conveyance of a subsequent sheet thereto.

In sheet processing machines, which are now presently known, the sheets are conveyed from one station to another by means of a conveyor which includes crosswise arranged bars on a pair of spaced continuous chain which bars are provided with grippers and are referred to as gripper bars. The gripper bars engage an edge of the sheet such as the leading edge and move it sequentially between the stations in the processing device such as a plate press which die cuts the sheet in one station and in a subsequent station strips waste from the die cut sheet. After conveying the sheet through the stations of the press, the gripper bars release the sheet which drops onto an endless conveyor belt which is continually operating and represents a first station of a subsequent sheet processing machine. The procedure of dropping a sheet which is released from the gripper bars onto the endless belt conveying device of the second machine presents several problems such as considerable insecurity with regard to the position and alignment of the sheet as it is deposited or dropped onto the endless conveyor belt. Another problem is a lack of positive control in the removal by the conveyor of the sheet which was dropped on the end of the endless conveyor belt.

SUMMARY OF THE INVENTION

The present invention is directed to a sheet transporting apparatus for use in sheet processing machines which maintains the position and alignment of a sheet deposited such as by dropping onto an endless conveyor belt and which apparatus provides positive control of the transporting of the sheet by the conveyor belt. To accomplish these tasks, the sheet transporting apparatus comprises a frame having means for receiving a sheet such as a receiving station, means for transporting a sheet from the means for receiving which means for transporting is disposed in the frame with one end receiving a portion of the sheet deposited in the means for receiving the sheet, pressing means coacting with the means for transporting to ensure nipping of the leading edge of the sheet between the pressing means and the means for transporting as the sheet is deposited in the sheet receiving means and means for shifting the pressing means between an advanced position engaging a leading edge of the sheet and a retracted position clear of the leading edge of the sheet as the leading edge is deposited on the transporting means.

Preferably, the means for transporting a sheet is either a single continuous belt or a plurality of continuous belts arranged in side-by-side relationship with means for continuously moving the single or plurality of belts. The pressing means preferably consists of a roller, a lever supporting the roller for rotation and mounted to pivot around an axle and wherein the means for shifting moves the axle in a linear path between a first and second position which linear path is obtained by a mechanical control acting on the axle such as guide tracks mounted on the frame and engaging the axle adjacent each end. The shifting means includes an actuator such as a pneumatic cylinder which is connected to the axle and to ensure that both ends of the axle move simultaneously the same distance, a pair of racks are engaged by pinions disposed on the ends of the axle which coact to convert the linear movement of the actuating means into rotation of the axle.

DESCRIPTION OF THE PREFERRED EMBODIMENT

Figure 1:
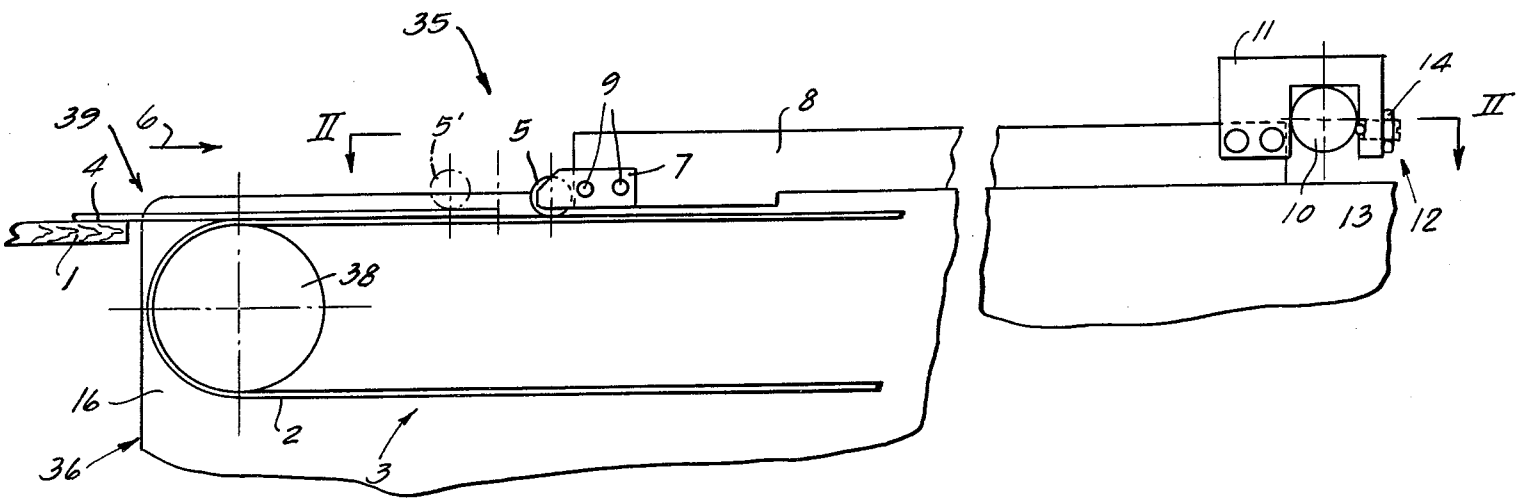
FIG. 1 is a partial side view with portions removed for purposes of illustration of a sheet transporting or carrying device in accordance with the present invention.

The principles of the present invention are particularly useful when incorporated in a sheet transporting apparatus generally indicated at 35 in FIG. 1, which apparatus is adapted for use in transporting a sheet such as 4 through a sheet processing device.

The sheet transporting apparatus 35 has a frame generally indicated at 36 which includes side members 16 and 17 (FIG. 2) with means for transporting a sheet such as a conveyor 3 extending therebetween. The conveyor 3 includes either one endless belt 2 or a plurality of endless belts 2 arranged in side-by-side relation and a plurality of belt sheaves or rollers such as 38 which rollers are mounted for rotation in the frame 36 and determine the path of the belts. At least one of the belt rollers is driven to form means for continuously moving the belts 2 in the direction of the arrow 6.

An end of the device 35 adjacent the belt sheave or roller 38 has a receiving station 39 which acts as means for receiving a sheet such as 4 which is deposited or carried onto the device such as being dropped thereon. When a sheet 4 is dropped in the receiving station 39, a leading portion rests on the belt 2 and the trailing portion can be supported by a tablet 1, which has a flat surface and is supported with the flat surface level with the belts 2 of the conveyor 3.

When a sheet 4 is in the receiving station and in the position illustrated in FIG. 1 on the conveyor 3, there is not sufficient gripping force by the belt 2 to move the sheet in the direction of arrow 6. To ensure an actual conveyance or movement of the sheet 4, a pressing roller or member 5 which is in contact with a transporting surface of the belt, is moved along the transporting surface from a retracted position, as illustrated, to an advanced position, which is illustrated in broken lines at 5', by a shifting device which is described hereinafter. When the roller 5 is moved to a forward or advanced position 5', it presses the leading edge portion of the sheet 4 onto the belt 2 with an adequate force which results in the sheet being moved in the direction of arrow 6. In other words, when in the advanced position 5', the roller 5 nips the leading edge portion of the sheet 4 between itself and the belt to ensure advancement of the sheet on the belt 2.

As illustrated, the roller 5 is mounted for rotation between a pair of plates 7, which are attached on an end of a lever 8 by screws 9. The opposite end of the lever 8 is pivotally mounted on the axis of an axle which axle extends perpendicularly to the direction of the arrow 6 and between the side frames 16 and 17. To pivotally mount the lever 8 on the axle, a pair of forks 11 which are attached to the lever, are clamped on a sleeve 10 of the axle by securing means 12 which includes a ball screw 13 and a counternut 14. Although only a single lever 8 and roller 5 is illustrated, a plurality of levers 8 may be clamped on the sleeve 10 and the securing means 12 enables the adjustment of the position of each lever 8 on the sleeve 10 and the addition and removal of other levers 8 and their pressure members 5.

Figure 2:
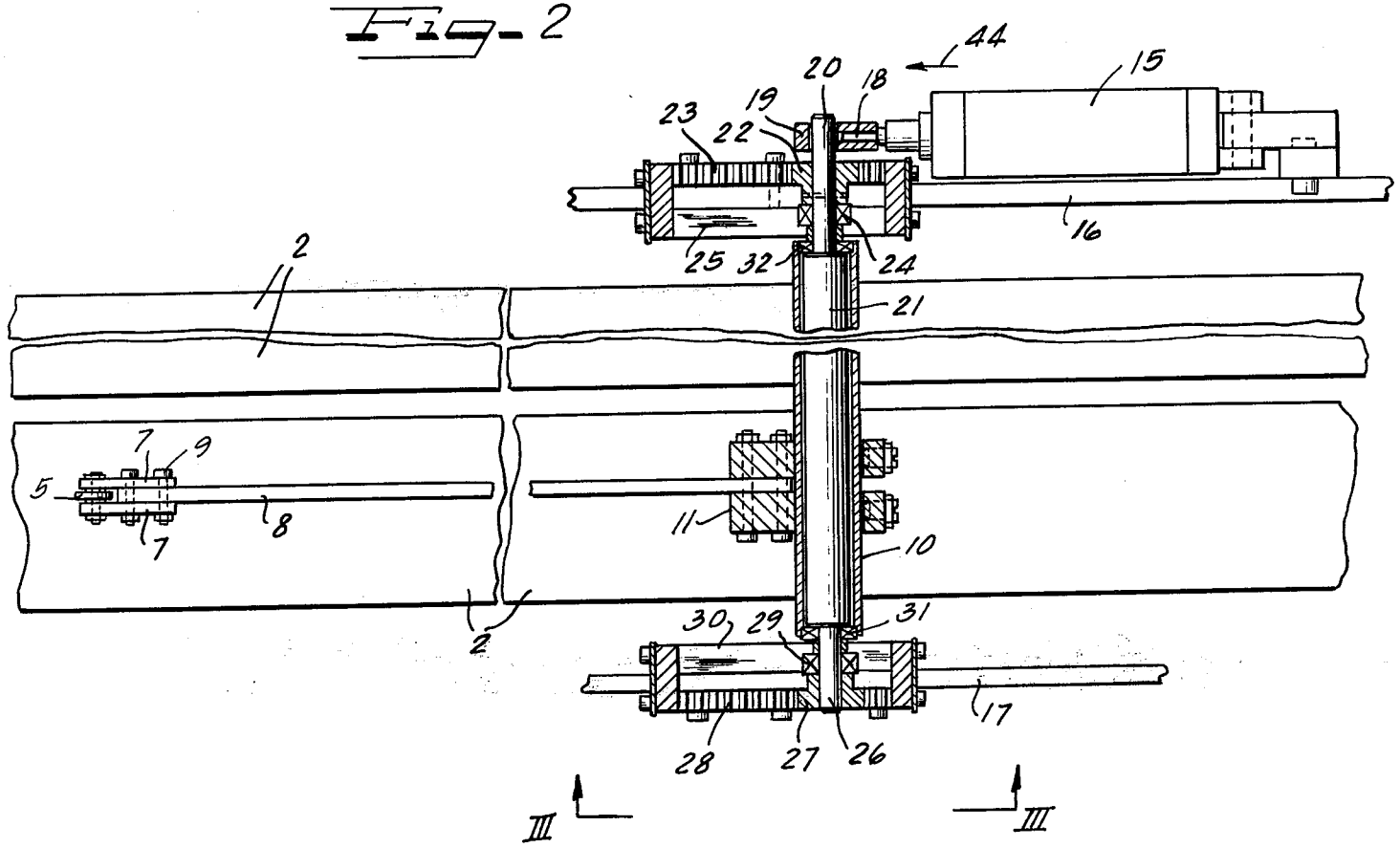
FIG. 2 is a partial cross section taken along lines II—II of FIG. 1 with portions in elevation for purposes of illustration.

The shifting of the pressure roller 5 is achieved by means of a double acting pneumatic cylinder, such as in air cylinder 15 which is secured on the frame member 16 and has a piston rod 18 (FIG. 2). The rod 18 is equipped with a bearing 19 which is received on an end 20 of a shaft 21. The end 20 receives a pinion gear 22 which is keyed to the shaft 21 by appropriate means to rotate therewith and the pinion gear 22 is received in a rack 23 which is attached to the side frame member 16 along with a slide rail 25. A bearing such as a ball bearing 24 is also mounted on the end 20 and its outer race rolls on the slide rail 25. In a similar manner, another end or opposite end 26 of the shaft 21 receives a pinion gear 27 which meshes with a rack gear 28 and has a ball bearing 29 whose outer race rolls on a slide rail 30. The ends 20 and 26 also have bearings such as ball bearings 31 and 32 to rotatably support the sleeve 10 on the shaft 21.

Figure 3:
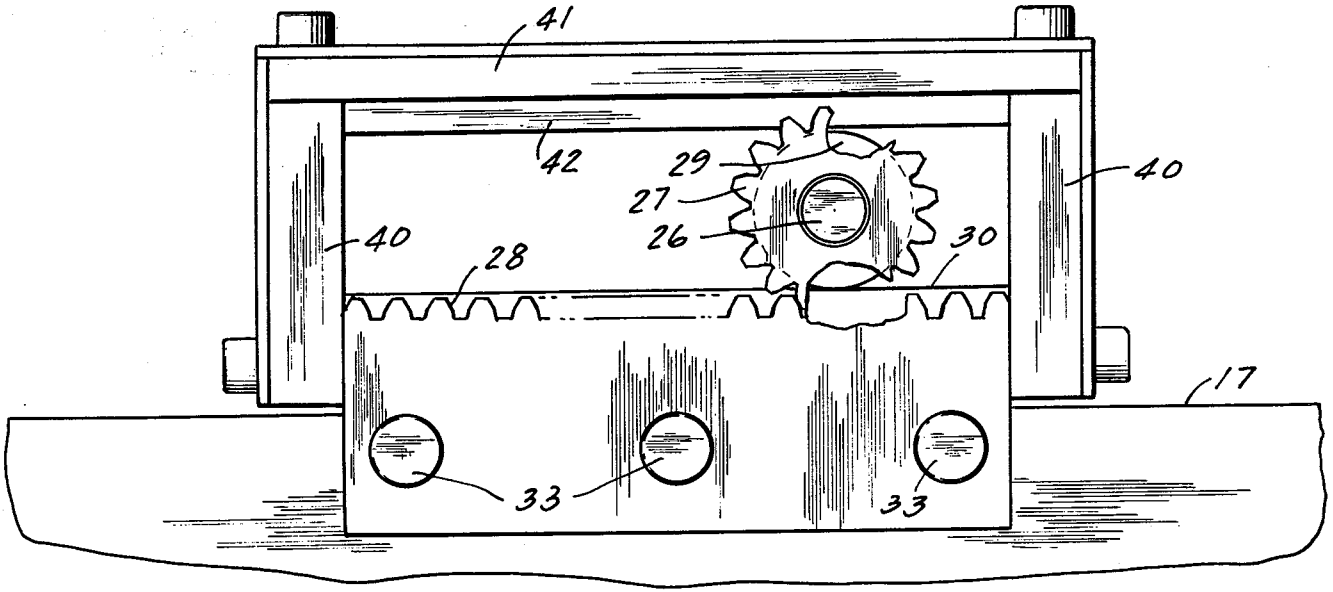
FIG. 3 is a partial side view with portions broken away for purposes of illustration taken along lines III—III of FIG. 2.

As best illustrated in FIG. 3, the rack gear 28 and slide rail 30 are a part of a housing having end members 40, 40 and a top member 41. The rack gear 28 is attached to the side frame member 17 by a plurality of machine screws such as 33 and mounts the housing thereon. The member 41 has a surface 42 which extends parallel to the slide rail 30 and coacts therewith to provide an elongated slot or track in which the roller bearing 29 is loosely entrapped as the pinion gear 27 is engaged on the rack 30.

When the pneumatic cylinder 15 is energized to move the rod 18 from the position illustrated in FIG. 2 in the direction of arrow 44, the linear movement of the ram or piston rod 18 is converted by the pair of pinions 22 and 27 coacting with their respective racks 23 and 28 into a rotary motion of the shaft 21 so that the two ends 20 and 26 of the shaft 21 are simultaneously moved in the same direction and through the same distance. Movement of the shaft 21 causes the roller 5 to move from the retracted position shown in bold lines to the advanced position 5' to engage the leading edge portion of the sheet 4 to cause the belt or belts 2 to transport the sheet in the direction of arrow 6. After the conveyor 3 begins to transport the sheet 4, the piston 15 withdraws the rod 18 to the retracted or first position to withdraw the roller 5 to the retracted position which is free from the leading edge portion of any subsequent sheet being deposited in the receiving station 39. Thus, the roller 5 will be clear of any sheet being deposited such as by dropping onto the receiving means so that the sheet contacts the belt or belts 2.

Control of the actuation of the cylinder 15 can be achieved by appropriate sensing devices. For example, a sensing device that senses the placement or depositing of a sheet 4 at the receiving means or station 39 can actuate the pneumatic cylinder to advance the roller 5 from the retracted position to the advanced position. As noted above, when the sheet 4 is at the receiving station, the leading edge is resting on the belt; however, the frictional force between the leading edge of the sheet and the belt is insufficient to cause the sheet to move in the direction of arrow 6. Thus, the time of the advancement of the sheet by the conveyor 3 is controlled by the time at which the pressure member 5 is shifted to the advanced position. Thus, the actuator 15 can be provided with a control circuit which initiates the movement of the pressure member 5 to the advanced position 5' at a time which is dependent upon subsequent processing steps to be formed on the sheet 4.

Although various minor modifications may be suggested by those versed in the art, I wish to employ within the scope of the patent granted hereon, all such modifications as reasonably and properly come within the scope of my contribution to the art.

I claim:

1. A sheet transporting apparatus for use in a sheet processing machine, comprising means for receiving a sheet, means including a transporting surface for transporting the sheet from the means for receiving the sheet, pressing means coacting with the means for transporting to ensure nipping of a leading edge of a sheet between the pressing means and the transporting surface of the means for transporting, and means for shifting the pressing means along the transporting surface between an advanced position engaging a leading edge of the sheet and a retracted position clear of the leading edge of the sheet as the leading edge is deposited on the transporting means.

2. A sheet transporting apparatus according to claim 1, wherein the means for receiving the sheet provides a flat surface.

3. A sheet transporting apparatus according to claim 1, wherein the means for transporting a sheet comprises at least one endless belt and means for continuously moving the continuous belt.

4. A sheet transporting apparatus according to claim 3, wherein the means for transporting a sheet comprises a plurality of continuous belts arranged in a side-by-side relationship.

5. A sheet transporting apparatus according to claim 1, wherein the pressing means consists of a roller, lever supporting said roller for rotation, said lever being mounted to pivot around an axle, and wherein the means for shifting moves the axle in a linear path between a first and second position.

6. A sheet transporting apparatus according to claim 5, wherein the means for shifting includes a pair of rack and pinion gears, said pinion gears being fixed to said axle and a pneumatic cylinder connected to said axle.

7. A sheet transporting apparatus according to claim 6, wherein the means for shifting further includes a mechanical control acting on the axle.

8. A sheet transporting apparatus for use in a sheet processing machine comprising a frame having a sheet receiving station, means including a transporting surface for transporting a sheet from the receiving station, said means for transporting being disposed in the frame with one end of the transporting surface receiving a portion of the sheet deposited in the sheet receiving station, pressing means coacting with the means for transporting to ensure nipping of the leading edge of a sheet between the pressing means and the transporting surface of the means for transporting as a sheet is deposited in the sheet receiving station, and means for shifting the pressing means along the transporting surface between an advanced position engaging a leading edge of a sheet and a retracted position clear of the leading edge of the sheet as the sheet is deposited at the sheet receiving station.

9. A sheet transporting apparatus according to claim 8, wherein the means for transporting comprises at least one endless belt and means for continuously moving the belt, and wherein the pressing means consists of a roller, a lever supporting said roller for rotation, said lever being mounted to pivot around an axle, and wherein the means for shifting includes spaced guide tracks on the frame so that the axle is moved in a linear path between a first and second position.

10. A sheet transporting apparatus according to claim 9, wherein a pair of rack gears are mounted on the frame adjacent to each guide means and wherein the axle has a pinion gear on each end coacting with the pair of racks and wherein the means for shifting includes an actuator engaging one end of the axle and shifting it between a first and second position so that linear motion of the actuating means is converted by the coaction of the pair of rack and pinions to rotate the axle to simultaneously shift both ends of the axle the same distance.

* * * * *